US011150054B1

(12) United States Patent
Bak

(10) Patent No.: US 11,150,054 B1
(45) Date of Patent: Oct. 19, 2021

(54) SCALABLE BODY ARMOR CARRIER SYSTEM FOR RIGID BALLISTIC PLATES AND SOFT BALLISTIC PANELS

(71) Applicant: The Government of the United States of America, as represented by the Secretary of Homeland Security, Washington, DC (US)

(72) Inventor: David Bak, Keedysville, MD (US)

(73) Assignee: The Government of the United States of America, as represented by the Secretary of Homeland Security, Washington, DC (US)

( * ) Notice: Subject to any disclaimer, the term of this patent is extended or adjusted under 35 U.S.C. 154(b) by 0 days.

(21) Appl. No.: 17/183,121

(22) Filed: Feb. 23, 2021

Related U.S. Application Data

(60) Provisional application No. 63/077,091, filed on Sep. 11, 2020.

(51) Int. Cl.
*F41H 1/02* (2006.01)
*F41H 5/013* (2006.01)

(52) U.S. Cl.
CPC ..... *F41H 1/02* (2013.01); *F41H 5/013* (2013.01)

(58) Field of Classification Search
CPC ..... F41H 1/02; F41H 5/013
USPC ..... 89/36.05
See application file for complete search history.

(56) References Cited

U.S. PATENT DOCUMENTS 3,557,384 A * 1/1971 Barron et al. ..... F41H 1/02 2/2.5
5,060,314 A * 10/1991 Lewis ..... F41H 1/02 2/2.5
7,424,748 B1 * 9/2008 McDunn ..... F41H 5/013 2/2.5
8,353,065 B1 * 1/2013 Crye ..... F41H 1/02 2/102
9,222,757 B2 * 12/2015 Seuk ..... F41H 1/02
2012/0246788 A1 * 10/2012 Harrell ..... A41D 13/0155 2/2.5
2012/0297527 A1 * 11/2012 Darnell ..... A44B 11/2519 2/455
2013/0084764 A1 * 4/2013 Swan ..... F41H 1/02 441/88
2015/0059042 A1 * 3/2015 Aquino ..... A41D 3/00 2/2.5

(Continued)

*Primary Examiner* — Samir Abdosh
(74) *Attorney, Agent, or Firm* — Lavanya Ratnam; Kelly G. Hyndman; Robert W. Busby

(57) ABSTRACT

In an example, a kit for assembling a scalable body armor for a wearer's body includes hard ballistic plates, soft ballistic panels, a plate carrier including a front plate carrier and a rear plate carrier connected by shoulder straps and having front and rear plate carrier pockets for receiving the hard ballistic plates, cummerbund portions extending laterally around the plate carrier and releasably connected to form a cummerbund around the wearer's body, a front panel carrier having a front outward facing side joinable to an inward facing side of the front plate carrier by contact and a front panel carrier pocket to receive one of the soft ballistic panels, and a rear panel carrier having a rear outward facing side joinable to an inward facing side of the rear plate carrier by contact and a rear panel carrier pocket to receive another one of the soft ballistic panels.

20 Claims, 10 Drawing Sheets

(56) References Cited

U.S. PATENT DOCUMENTS

| | | | | |
|---|---|---|---|---|
| 2015/0323289 | A1* | 11/2015 | Seuk | F41H 1/02 89/36.05 |
| 2015/0345910 | A1* | 12/2015 | Searle | A41D 1/04 2/2.5 |
| 2016/0003581 | A1* | 1/2016 | Warren | A41D 13/055 2/2.5 |
| 2016/0206019 | A1* | 7/2016 | Crye | F41H 1/02 |
| 2016/0347431 | A1* | 12/2016 | Kent | B63C 9/1255 |
| 2017/0082404 | A1* | 3/2017 | Blauer | A41D 27/02 |
| 2017/0199011 | A1* | 7/2017 | Beck | F41H 5/013 |
| 2018/0128577 | A1* | 5/2018 | Beck | A41D 1/04 |
| 2018/0160744 | A1* | 6/2018 | Blauer | A41D 13/05 |
| 2019/0041167 | A1* | 2/2019 | Swan | A45F 3/14 |
| 2021/0000246 | A1* | 1/2021 | Alson | A45F 3/06 |
| 2021/0071995 | A1* | 3/2021 | Ganor | F41H 1/02 |
| 2021/0088311 | A1* | 3/2021 | Ross | F41H 5/013 |

* cited by examiner

SCALABLE BODY ARMOR CARRIER SYSTEM FOR RIGID BALLISTIC PLATES AND SOFT BALLISTIC PANELS

CROSS-REFERENCE TO RELATED APPLICATIONS

The application claims the benefit of priority from U.S. Provisional Patent Application No. 63/077,091, filed on Sep. 11, 2020, entitled SCALABLE BODY ARMOR CARRIER SYSTEM FOR RIGID BALLISTIC PLATES AND SOFT BALLISTIC PANELS, the disclosure of which is incorporated by reference in its entirety.

SUMMARY STATEMENT OF GOVERNMENT INTEREST

The present invention was made by employees of the United States Department of Homeland Security in the performance of their official duties. The U.S. Government has certain rights in this invention.

FIELD

The discussion below relates generally to systems and methods of providing personal body armor and, more particularly, to scalable body armor carrier system, kit, and method.

BACKGROUND

Personal ballistic body armor has evolved dramatically over the last 50 years. Evolutionary progress has been made in materials and design for the production of soft, handgun rated armor panels as well as hard, rifle rated ballistic plates. As materials and technology improved, weights and thickness of body armor decreased. This led to the increased usage of body armor for both military and law enforcement. Traditionally, within the law enforcement community, body armor has been worn in a concealed fashion under one's uniform and consisted primarily of handgun rated ballistic panels. However, wearing armor in this manner tends to be hot and uncomfortable. The external wearing of body armor and/or the use of rifle rated ballistic plates was primarily reserved for specialty units. The external carriers for this application tended to be bulky and have many layers of fabric, and were fairly consistent in their basic core design. External carriers were designed around a base intended to hold soft armor panels, but had axillary pockets intended to hold hard armor ballistic plates. Whether the plate holding pockets were located on the outside of the carrier or inside the carrier's material configuration, they were fixed as integral to the carrier. The suspension system components (shoulder straps and cummerbund), which affixed the armor carrier to the end user, were part of this soft armor base located more closely to the body of the wearer.

As the levels of violence and threats have increased, the wearing of armor externally (outside the uniform) has become much more prevalent. Initially, many officers would simply wear their internal, concealable armor in the same carrier but on the outside. As demand increased, however, variations of the traditional external carrier became more prevalent. At the same time, the proliferation of rifle threats to law enforcement increased. Now, the use of rifle rated plate armor has also become much more common. This also contributed to new external carrier designs, capable of holding both soft and hard ballistic armor, but intended for use by regular personnel on a daily basis.

While those new designs are intended for regular daily use, they still rely on the basic design of a carrier base that is intended to hold soft armor panels with auxiliary pockets configured to hold hard plate armor. This means that the carrier is designed to hold either soft armor panels alone or soft armor panels with hard plates. These are the only two configurations as both soft and hard armor carriers are combined both into one piece. Additionally, it is recognized that there are ballistic carriers designed solely for carrying ballistic hard plates and ones that combine a ballistic hard plate carrier for front and back protection with soft armor contained in a cummerbund for side protection. Many officers have transitioned to wearing only hard plates due to heat and weight constraints while addressing a wide variety of threats. However, these designs require the hard plates to be worn at all times to provide requisite front and back protection.

SUMMARY

Various embodiments are directed to apparatuses and methods for providing a streamlined, scalable, body armor carrier system that offers user flexibility in body armor configuration depending on tactical, operational, and environmental considerations. The carrier system may be of a modular construction. One embodiment is directed to a dual armor variably enhanced body armor kit.

All the designs discussed previously limit the flexibility of the carrier system to be configured to the end user's needs. This means that officers and other wearers have a limited ability to structure their armor to best suit the operational and/or environmental requirements. Logistically and financially speaking, it also means that multiple systems would have to be provided or purchased to give the wearers the ability to configure their ballistic armor in a way that makes sense for their environmental or operational needs.

In contrast, the dual armor variably enhanced body armor kit according to an embodiment will provide a significant level of flexibility by allowing the user to personally configure the carrier and associated armor, at a moment's notice, to achieve an improved level if not the optimal level of protection and comfort. This will reduce weight, heat retention, and extra bulk when the end user determines that wearing both soft and hard armor simultaneously is not appropriate or necessary. All of this will be possible using one carrier system that is user configurable as opposed to multiple carriers (i.e., a common outer garment carrier and a separate plate carrier).

In accordance with one aspect, a kit for assembling a scalable body armor for a wearer's body comprises: a plurality of hard ballistic plates; a plurality of soft ballistic panels; a plate carrier including a front plate carrier and a rear plate carrier connected by shoulder straps, cummerbund portions extending laterally around the front plate carrier and the rear plate carrier and releasably connected to form a cummerbund around the wearer's body, the front plate carrier including a front plate carrier pocket to receive one of the hard ballistic plates, the rear plate carrier including a rear plate carrier pocket to receive another one of the hard ballistic plates, the front plate carrier having a front plate carrier attachment portion on an inward facing side which faces the wearer's body, the rear plate carrier having a rear plate carrier attachment portion on an inward facing side which faces the wearer's body; a front panel carrier including a front panel carrier pocket to receive one of the soft ballistic panels and a front panel carrier attachment portion on an outward facing side which faces away from the wearer's body, the front panel carrier attachment portion and the front plate carrier attachment portion being configured to be releasably joinable together by contact with one another; and a rear panel carrier including a rear panel carrier pocket to receive another one of the soft ballistic panels and a rear panel carrier attachment portion on an outward facing side which faces away from the wearer's body, the rear panel carrier attachment portion and the rear plate carrier attachment portion being configured to be releasably joinable together by contact with one another.

In accordance with another aspect, a scalable body armor system for a wearer's body comprises: a plate carrier including a front plate carrier and a rear plate carrier connected by shoulder straps, cummerbund portions extending laterally around the front plate carrier and the rear plate carrier, the front plate carrier including a front plate carrier pocket to receive a hard ballistic plate, the rear plate carrier including a rear plate carrier pocket to receive another hard ballistic plate, the front plate carrier having a front plate carrier attachment portion on an inward facing side which faces the wearer's body, the rear plate carrier having a rear plate carrier attachment portion on an inward facing side which faces the wearer's body; a front panel carrier including a front panel carrier pocket to receive a soft ballistic panel and a front panel carrier attachment portion on an outward facing side which faces away from the wearer's body, the front panel carrier attachment portion and the front plate carrier attachment portion being configured to be releasably joinable together by contact with one another; and a rear panel carrier including a rear panel carrier pocket to receive another soft ballistic panel and a rear panel carrier attachment portion on an outward facing side which faces away from the wearer's body, the rear panel carrier attachment portion and the rear plate carrier attachment portion being configured to be releasably joinable together by contact with one another. The cummerbund portions are configured to be releasably connected to form a cummerbund around the wearer's body which (i) presses the front panel carrier attachment portion and the front plate carrier attachment portion together and (ii) presses the rear panel carrier attachment portion and the rear plate carrier attachment portion together to form an integrated body armor around the wearer's body.

In accordance with yet another aspect, a kit-of-parts for assembling a scalable body armor for a wearer's body comprises: a plurality of hard ballistic plates; a plurality of soft ballistic panels; a plate carrier including a front plate carrier and a rear plate carrier connected by shoulder straps, the front plate carrier including a front plate carrier pocket to receive one of the hard ballistic plates, the rear plate carrier including a rear plate carrier pocket to receive another one of the hard ballistic plates, the front plate carrier having a front plate carrier attachment portion on an inward facing side which faces the wearer's body, the rear plate carrier having a rear plate carrier attachment portion on an inward facing side which faces the wearer's body; a front panel carrier including a front panel carrier pocket to receive one of the soft ballistic panels and a front panel carrier attachment portion on an outward facing side which faces away from the wearer's body, the front panel carrier attachment portion and the front plate carrier attachment portion being configured to be releasably joinable together by contact with one another; a rear panel carrier including a rear panel carrier pocket to receive another one of the soft ballistic panels and a rear panel carrier attachment portion on an outward facing side which faces away from the wearer's body, the rear panel carrier attachment portion and the rear plate carrier attachment portion being configured to be releasably joinable together by contact with one another; and cummerbund portions configured to be releasably connected to form a cummerbund around the wearer's body, with the cummerbund portions extending from the rear plate carrier and attached to the front plate carrier, the cummerbund (i) pressing the front panel carrier attachment portion and the front plate carrier attachment portion together and (ii) pressing the rear panel carrier attachment portion and the rear plate carrier attachment portion together to form an integrated body armor around the wearer's body.

Other features and aspects of various examples and embodiments will become apparent to those of ordinary skill in the art from the following detailed description which discloses, in conjunction with the accompanying drawings, examples that explain features in accordance with embodiments. This summary is not intended to identify key or essential features, nor is it intended to limit the scope of the invention, which is defined solely by the claims.

BRIEF DESCRIPTION OF THE DRAWINGS

The attached drawings help explain the embodiments described below.

DETAILED DESCRIPTION

A number of examples or embodiments of the present invention are described, and it should be appreciated that the present invention provides many applicable inventive concepts that can be embodied in a variety of ways. The embodiments discussed herein are merely illustrative of ways to make and use the invention and are not intended to limit the scope of the invention. Rather, as will be appreciated by one of skill in the art, the teachings and disclosures herein can be combined or rearranged with other portions of this disclosure along with the knowledge of one of ordinary skill in the art.

Embodiments encompass a design process of affixing two separate ballistic armor carriers into a single cohesive, scalable unit designed for personal wear. The outward most carrier includes separate front and rear components (referred to as a plate carrier when they are together). They are configured to hold hard or rigid rifle rated ballistic plate armor and include all necessary suspension required for personal wearability. The other carrier also includes separate front and rear components (referred to as a panel carrier when they are together) which are configured to hold soft handgun rated ballistic panel armor. The plate carrier may be worn independently or the plate carrier and the panel carrier may be affixed to form a single unit, whereby, the wearer may choose to place hard plates or soft panels or both hard plates and soft panels in the carriers in a scalable manner based on tactical, operational, and environmental considerations.

Figure 1:
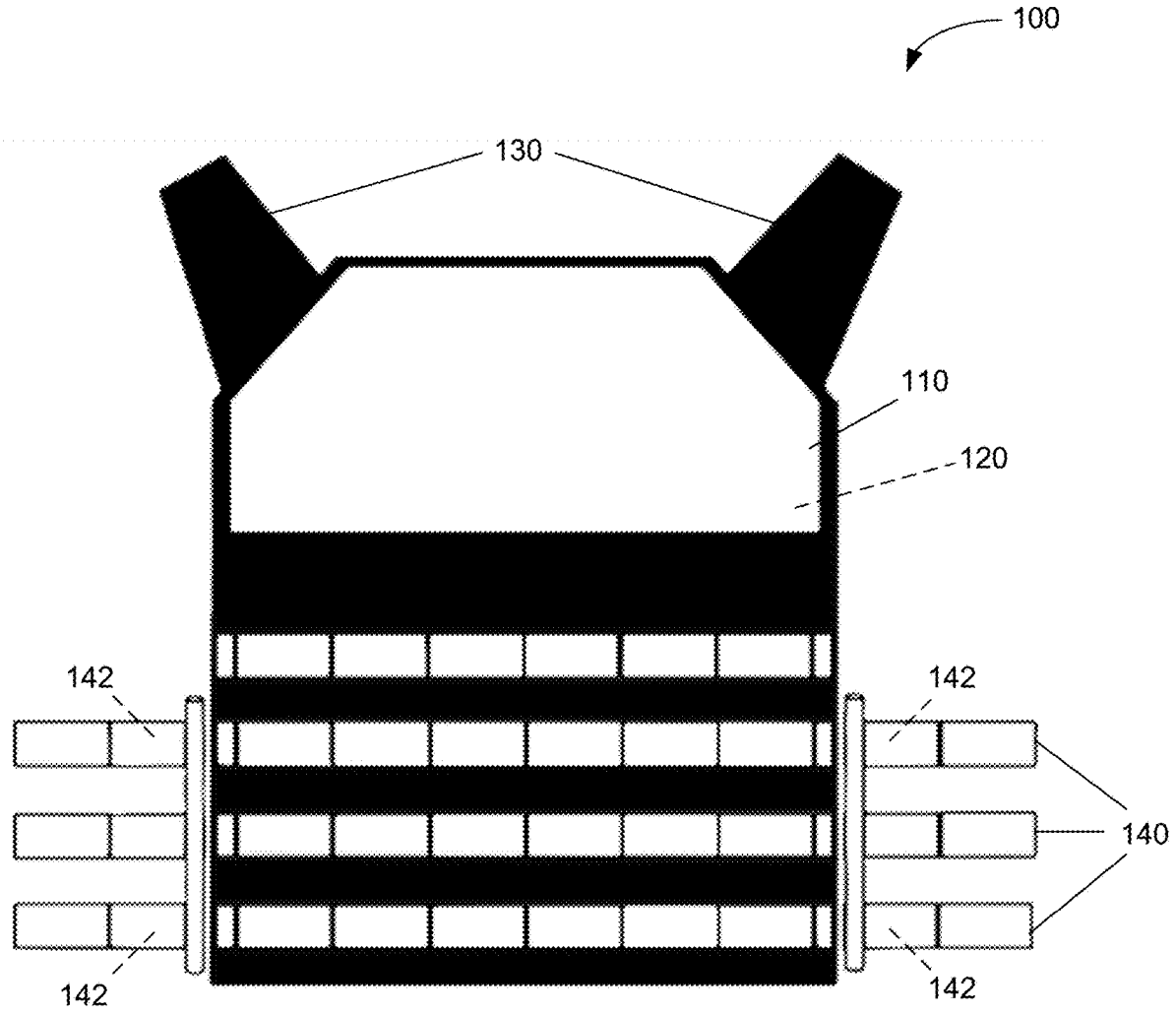
FIG. 1 illustrates an outward facing side of a front plate carrier which is a front portion of a plate carrier.

FIG. 1 illustrates an outward facing side of a front plate carrier which is a front portion of a plate carrier. The front plate carrier 100 may have a front body portion or front garment portion 110 that holds a rigid ballistic plate 120 (shown in broken lines indicating plate 120 is hidden inside the front body portion 110) which may be approximately the same in shape as the front body portion 110 of the front plate carrier 100. The front plate carrier 100 may include a pair of shoulder straps 130. A plurality of cummerbund portions 140 are provided laterally to both sides of the front body portion 110. The cummerbund portions 140 may be side straps that form a releasable cummerbund around the wearer's body utilizing quick release mechanisms located on the outside left and right edges of the front plate carrier 100. The plate carrier (100, 200) may be made of materials such as nylon, Hypalon, aramid-based thread, or the like.

Figure 2:
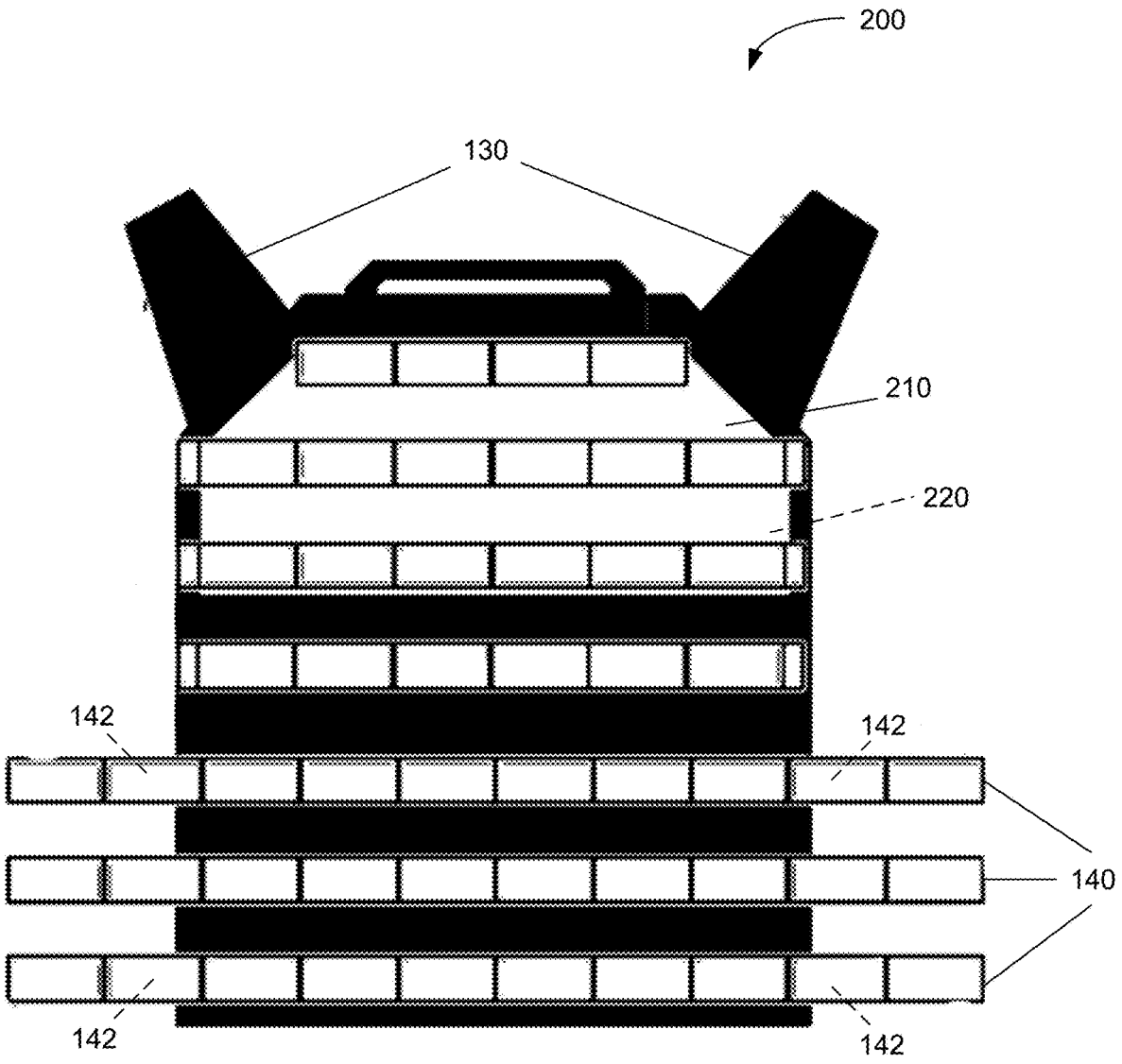
FIG. 2 illustrates an outward facing side of a rear plate carrier which is a rear portion of the plate carrier.

FIG. 2 illustrates an outward facing side of a rear plate carrier which is a rear portion of the plate carrier. The rear plate carrier 200 may have a rear body portion or garment portion 210 that holds a rigid ballistic plate 220 (shown in broken lines indicating plate 220 is hidden inside the rear body portion 210) that may be approximately the same in shape as the rear body portion 210 of the rear plate carrier 200. The pair of shoulder straps 130 connect the rear body portion 210 of the rear plate carrier 200 with the front body portion 110 of the front plate carrier 100. The cummerbund portions 140 may include both passive and/or active adjustability, extend laterally to both sides of the rear body portion 210 and be fastened to the front plate carrier 100. For example, the cummerbund portions 140 may be connected (e.g., via quick release clips or other fastening members or the like, typically in the front of the wearer's body) to form a cummerbund around the wearer's body in the waist region.

In one example, a removable cummerbund extends laterally from the rear plate carrier 200 to the right and left sides of the wearer's body and is attached to the rear panel carrier 200 using an active adjustability mechanism and to the front plate carrier 100 using a quick release mechanism. The cummerbund portions 140 form the cummerbund around the wearer's body in the waist region. The cummerbund portions 140 may extend laterally to both sides of the rear body portion 210, be affixed to the rear plate carrier 200, and allow for both active and passive adjustment of length.

In one embodiment, the cummerbund portions 140 forming the cummerbund may include ballistic material to provide additional protection especially on the left and right sides of the wearer's body which may not be adequately covered by the hard ballistic plates and/or soft ballistic panels. For example, the cummerbund portions 140 may include cummerbund pockets 142, either integrally (built-in) or separately but attached or releasably connected, to receive cummerbund inserts including soft armor inserts or soft ballistic inserts, such as those that are commercially available. That is, the cummerbund portions 140 may include cummerbund pockets or has the ability to accept attachable pockets to receive the soft ballistic inserts.

The shoulder straps 130 and cummerbund portions 140 forming the cummerbund connect the front plate carrier 100 and rear plate carrier 200 to form the plate carrier and affix the plate carrier (100, 200) to the body of the wearer. The front plate carrier 100 covers the front of the wearer's body and the rear plate carrier 200 covers the rear of the wearer's body.

Figure 3:
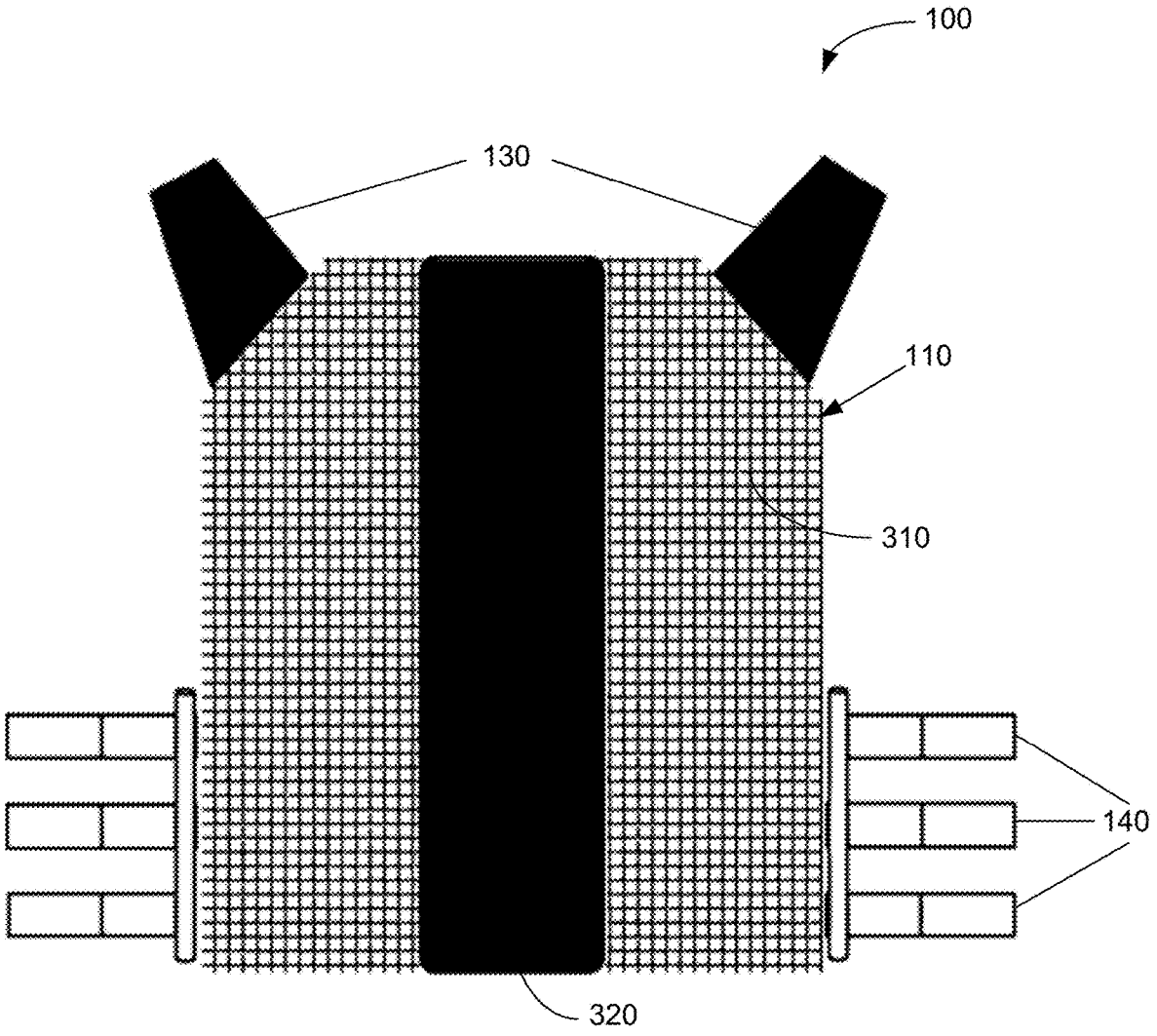
FIG. 3 illustrates a body facing or inward facing side of the front plate carrier of FIG. 1.

FIG. 3 illustrates a body facing or inward facing side of the front plate carrier 100 of FIG. 1. The inward facing side may have a textured portion 310 representing loop material. A front vertical strip 320 represents a stretch material or stretch fabric (e.g., Lycra®, elastane, spandex, or other synthetic fibers) that allows for expansion of the front plate carrier 100 to fit and contour to the front hard plate when inserted. In the embodiment shown, the strip 320 separates the textured portion 310 into left and right parts or segments. The strip 320 and textured portion 310 cover substantially the entire surface area of the inward facing side of the front plate carrier 100 (e.g., at least about 80% or at least about 90% or at least about 95%).

Figure 4:
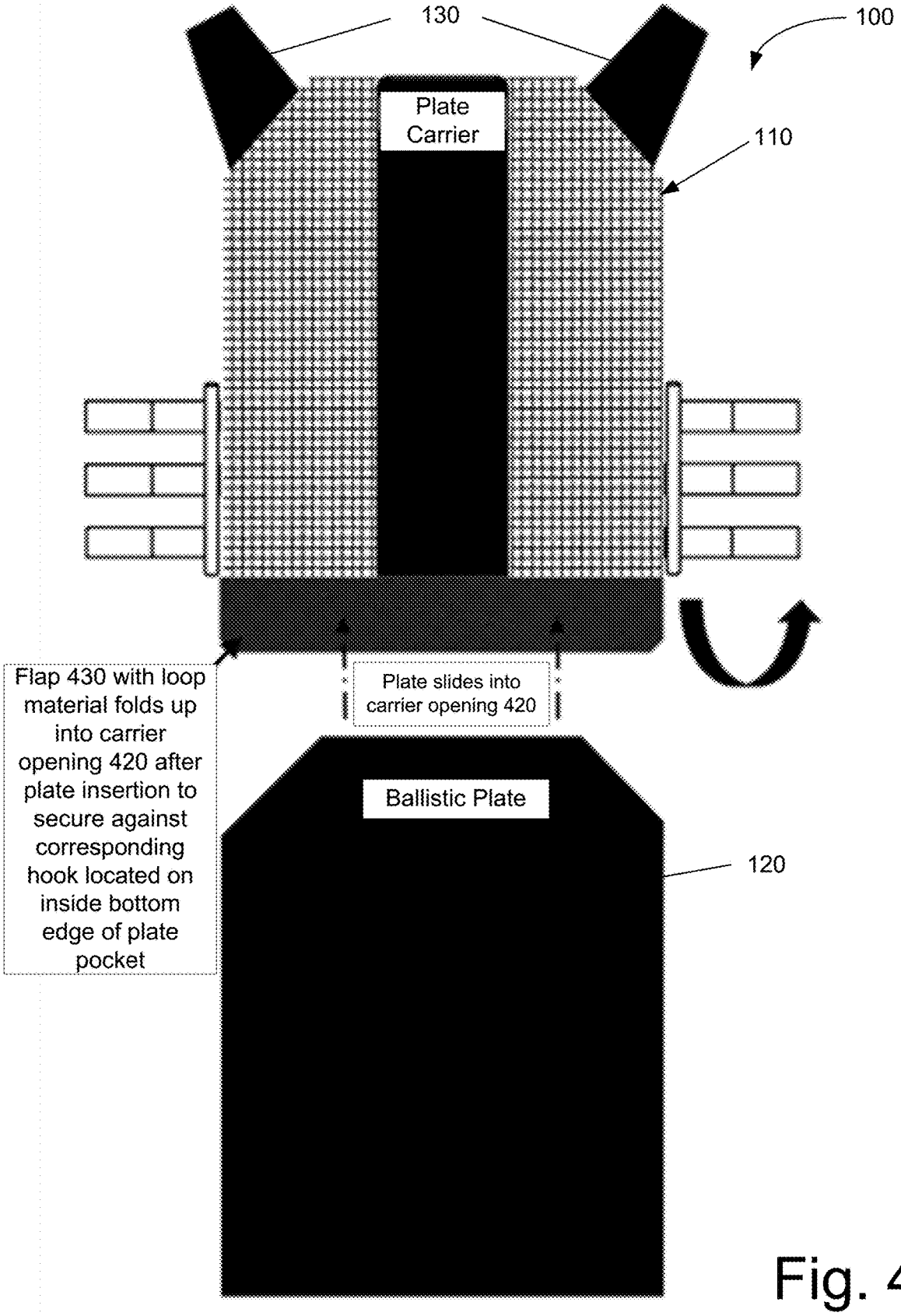
FIG. 4 illustrates insertion of a hard ballistic plate into a plate carrier.

FIG. 4 illustrates insertion of a hard ballistic plate into a plate carrier. Ballistic plates can be inserted into the front plate carrier 100 and rear plate carrier 200 in similar or different manners. The front plate carrier 100 may include a front plate carrier pocket to receive a hard ballistic plate. In the example shown, the hard ballistic plate 120 is inserted through a carrier opening 420 at the bottom of the front plate carrier 100. After sliding the front hard plate 120 into the front plate carrier 100 through the carrier opening 420 to the plate carrier pocket, a flap 430 with loop material is folded up into the carrier opening 420 to secure against corresponding hook material located on the inside bottom edge of the plate carrier pocket. Similarly, the rear plate carrier 200 may include a rear plate carrier pocket to receive a rear hard ballistic plate utilizing a similar construction as that shown in FIG. 4.

Figure 5:
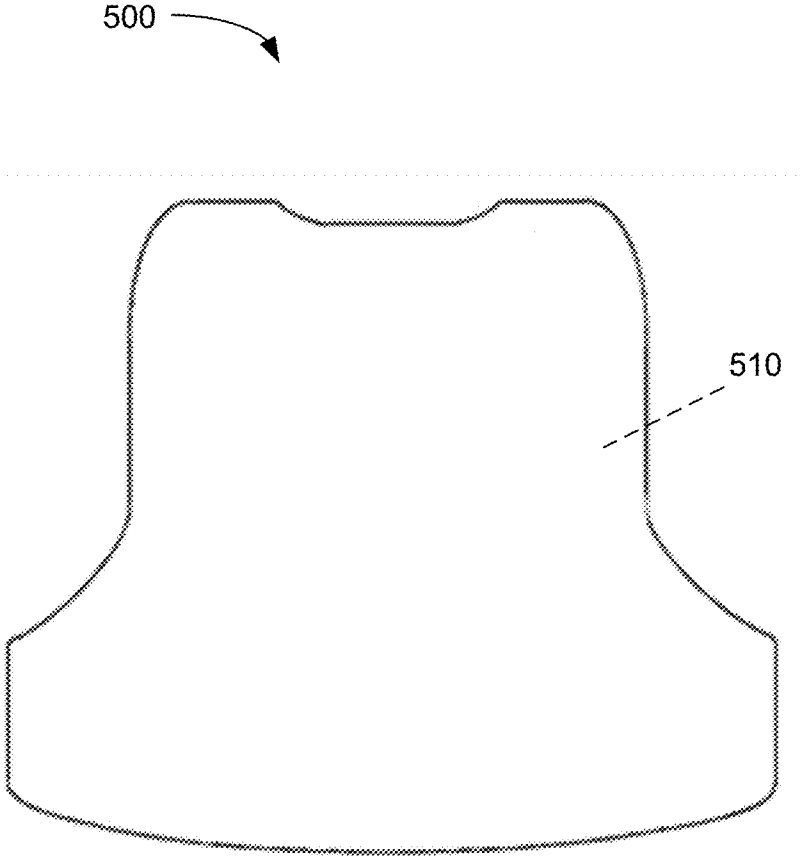
FIG. 5 illustrates a front panel carrier which is a front portion of a panel carrier.

FIG. 5 illustrates a front panel carrier which is a front portion of a panel carrier. The front panel carrier 500 may have a front fabric pouch configured to contain a soft ballistic panel 510. Each front pouch may include an opening or pocket located on the body facing or inward facing side for insertion of the soft ballistic panel. When the front panel carrier 500 is used in combination with the front plate carrier 100, the front panel carrier 500 is the innermost carrier. The shape of the panel carrier and soft ballistic panel may vary (e.g., concealable cut panel shape, plate backer shape, or any variation thereof.)

Figure 6:
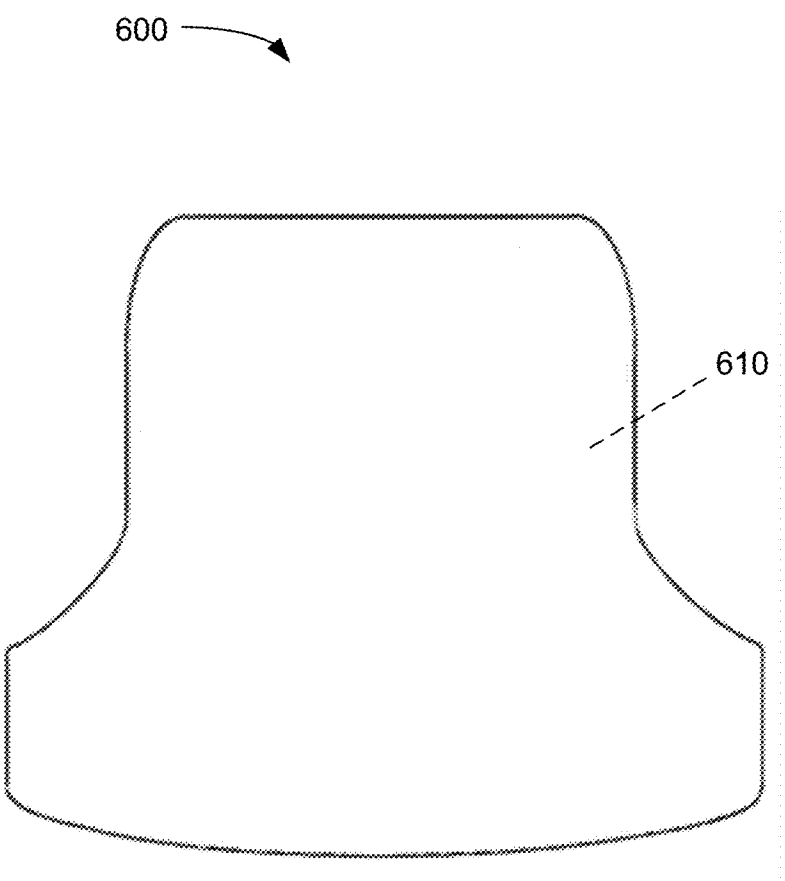
FIG. 6 illustrates a rear panel carrier which is a rear portion of the panel carrier.

FIG. 6 illustrates a rear panel carrier which is a rear portion of the panel carrier. The rear panel carrier 600 may have a rear fabric pouch configured to contain a soft ballistic panel 610. Each rear pouch may include an opening or pocket located on the body facing or inward facing side for insertion of the soft ballistic panel. When the rear panel carrier 600 is used in combination with the rear plate carrier 200, the rear panel carrier 600 is the innermost carrier. The shape of the panel carrier and soft ballistic panel may vary (e.g., concealable cut panel shape, plate backer shape, or any variation thereof.)

Figure 7:
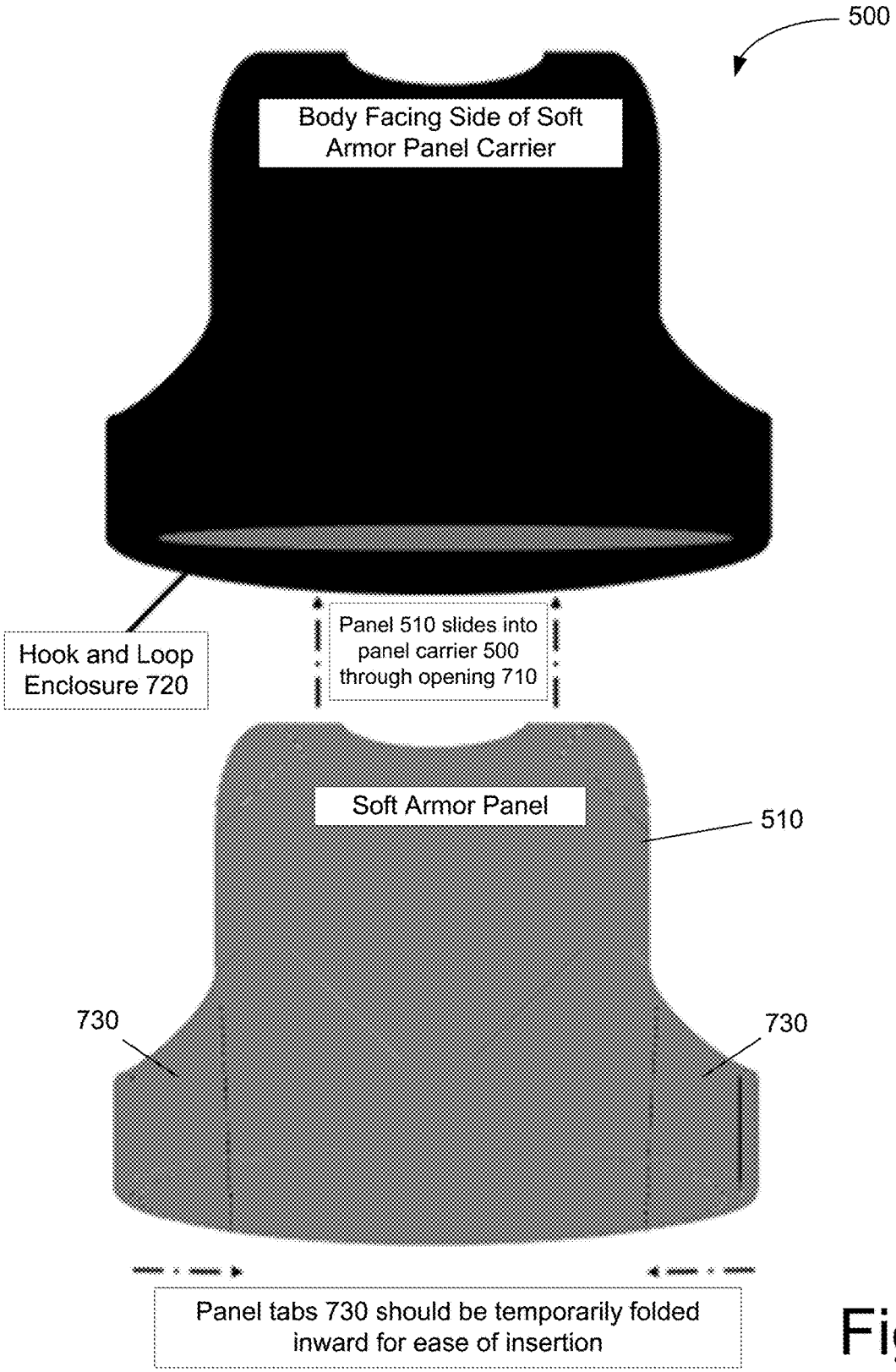
FIG. 7 illustrates insertion of a soft ballistic panel into a panel carrier.

FIG. 7 illustrates insertion of a soft ballistic panel into a panel carrier. The front panel carrier 500 may include a front panel carrier pocket or pouch to receive a soft ballistic panel 510. Similarly, the rear panel carrier 600 may include a rear panel carrier pocket or pouch to receive a soft ballistic panel 610. The insertion of soft ballistic panels into the pouch openings of the front panel carrier 500 and the rear panel carrier 600 can be accomplished by various mechanisms or means. One example involves the use of a hook and closure method for the carrier opening 710, configured to be wide enough to facilitate ease of insertion of the front soft panel 510, and to be located towards the bottom of the front panel carrier 500 but not directly at the bottom edge. The front soft panel 510 slides into the front panel carrier 500 through the carrier opening 710. A hook and loop enclosure 720 may be provided at the bottom to enclose the soft panel 510 after insertion. For ease of insertion of the soft panel 510 into the panel carrier 500, the panel tabs 730 may be temporarily folded inward before insertion and then unfolded after insertion.

Figure 8:
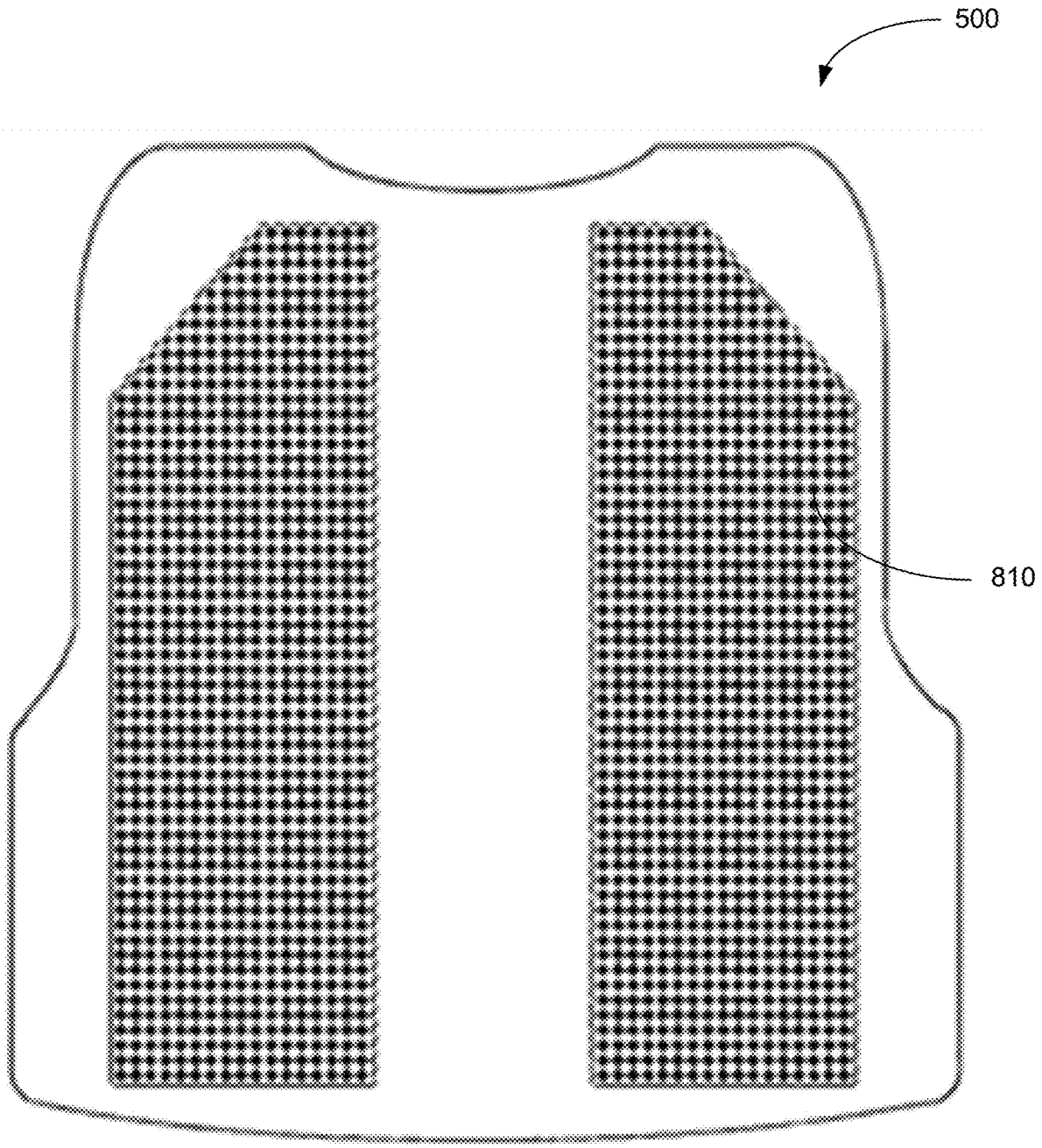
FIG. 8 illustrates an outward facing side of the front panel carrier of FIG. 5.

FIG. 8 illustrates an outward facing side of the front panel carrier 500 of FIG. 5. The outward facing side may have a textured portion 810 representing hook material. The loop material portion 310 and the hook material portion 810 may be mirror images of one another. The hook material portion 810 of the front panel carrier 500 engages with the loop material portion 310 of the front plate carrier 100 to fasten and combine the "inner" front panel carrier 500 and the "outer" front plate carrier 100.

Similarly, a body facing or inward facing side of the rear plate carrier 200 may include a textured portion representing loop material and a rear vertical strip representing a stretch material or stretch fiber, and an outward facing side of the rear panel carrier 600 may include a textured portion representing hook material. The hook material portion of the rear panel carrier 600 engages with the loop material portion of the rear plate carrier 200 to fasten and combine the "inner" rear panel carrier 600 and the "outer" rear plate carrier 200. The textured portion and rear vertical strip of the inward facing side of the rear plate carrier 200 may be substantially the same as the textured portion 310 and the front vertical strip 320 of the inward facing side of the front plate carrier 100. The textured portion of the outward facing side of the rear panel carrier 600 may be substantially the same as the textured portion 810 of the outward facing side of the front panel carrier 200. The rear vertical strip and textured portion may cover substantially the entire surface area of the inward facing side of the rear plate carrier 200 (e.g., at least about 80% or at least about 90% or at least about 95%).

One aspect of the present system is that the wearer can wear the plate carrier (100, 200) individually or in combination with the panel carrier (500, 600). By utilizing a mechanical nonabrasive material such as loop material (instead of hook material) on the body facing or inward facing side of the plate carrier (100, 200), this design allows the plate carrier (100, 200) to be worn independently (i.e., not in combination with the panel carrier (500, 600)) without causing damage to the clothing of the wearer or discomfort to the wearer's skin.

Figure 9:
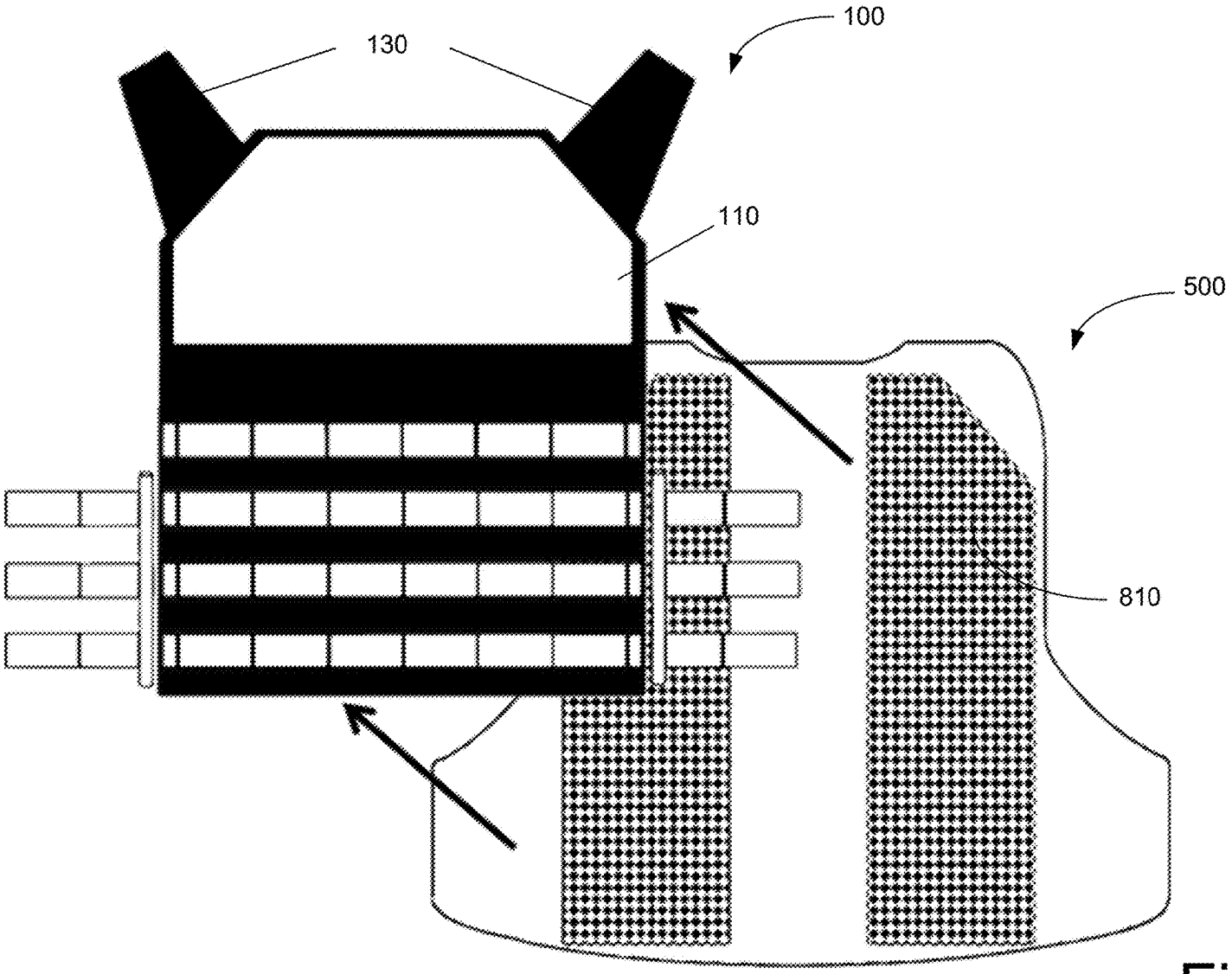
FIG. 9 illustrates a process of combining the front plate carrier of FIGS. 1 and 7 and the front panel carrier of FIGS. 5 and 8.

FIG. 9 illustrates a process of combining the front plate carrier 100 of FIGS. 1 and 7 and the front panel carrier 500 of FIGS. 5 and 8. To combine the two carriers, the inward facing side of the front plate carrier 100 and the outward facing side of the front panel carrier 500 may be pushed together to affix the loops to the corresponding hooks forming a front hook and loop fastener closure system. Similarly, the inward facing side of the rear plate carrier 200 and the outward facing side of the rear panel carrier 600 may be pushed together to affix the loops to the corresponding hooks forming a rear hook and loop fastener closure system.

Therefore, the front plate carrier 100 may have a front plate carrier attachment portion in the form of the front loop material portion 310 on the inward facing side which faces the wearer's body. The front panel carrier 500 may have a front panel carrier attachment portion in the form of the front hook material portion 810 on the outward facing side which faces away from the wearer's body. The front panel carrier attachment portion (hook material portion 810) and the front plate carrier attachment portion (loop material portion 310) may be configured to be releasably joinable together by contact with one another.

Similarly, the rear plate carrier may include a rear plate carrier attachment portion in the form of a rear loop material portion on an inward facing side which faces the wearer's body and the rear panel carrier may include a rear panel carrier attachment portion in the form of a rear hook material portion on an outward facing side which faces away from the wearer's body. The rear panel carrier attachment portion and the rear plate carrier attachment portion may be configured to be releasably joinable together by contact with one another.

In forming the cummerbund, the cummerbund portions 140 may extend from the rear plate carrier 200 and be fastened to the front plate carrier 100. When the cummerbund portions 140 are fastened, the cummerbund presses the front panel carrier attachment portion (hook material portion 810) and the front plate carrier attachment portion (loop material portion 310) together and presses the rear panel carrier attachment portion and the rear plate carrier attachment portion together to form an integrated body armor around the wearer's body.

Figure 10:
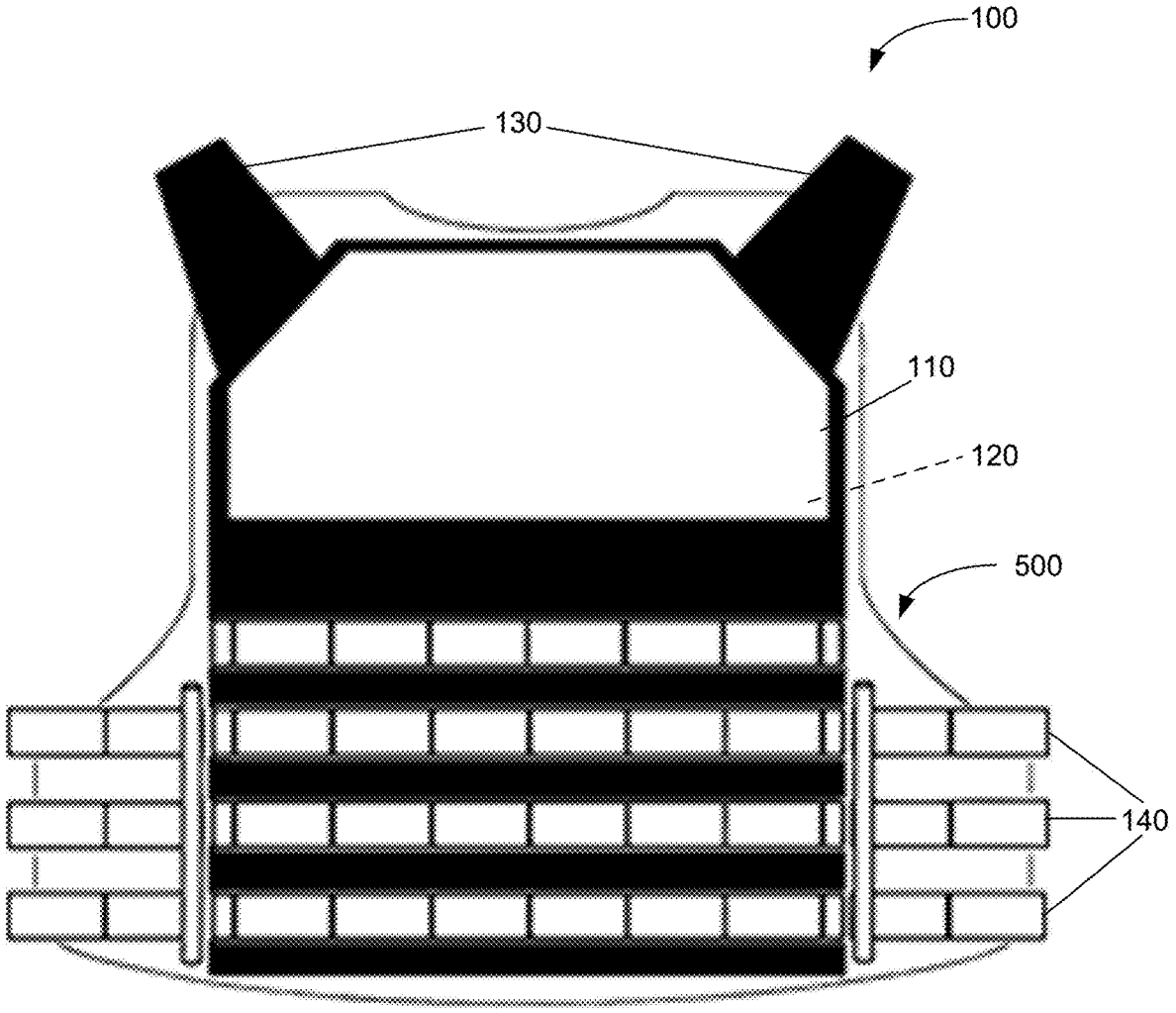
FIG. 10 illustrates an outward facing side of a combined front plate carrier and front panel carrier.
Figure 11:
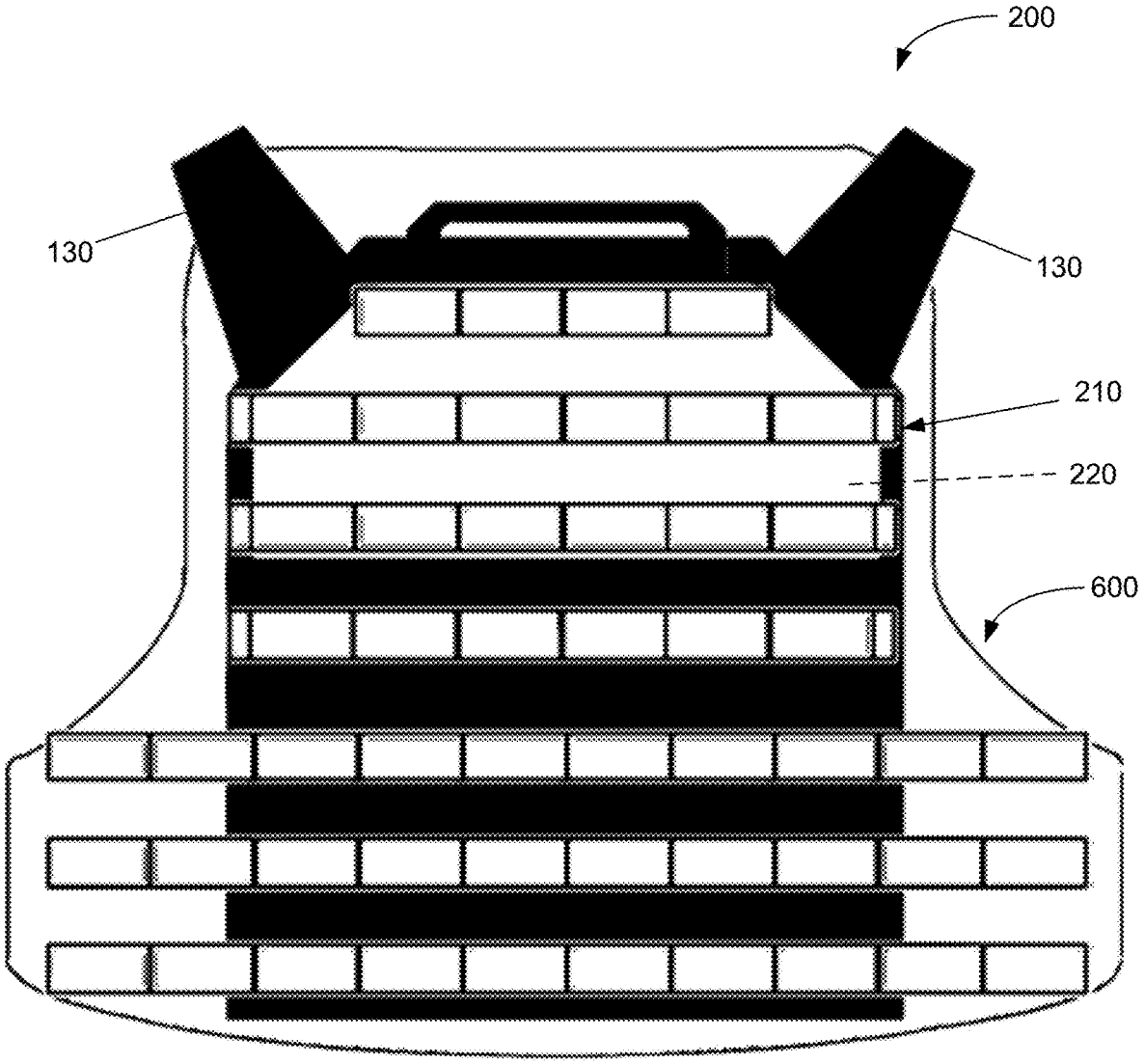
FIG. 11 illustrates an outward facing side of a combined rear plate carrier and rear panel carrier.

The combined carriers create a complete kit. FIG. 10 illustrates an outward facing side of a combined front plate carrier 100 and front panel carrier 500. FIG. 11 illustrates an outward facing side of a combined rear plate carrier 200 and rear panel carrier 600.

Because the suspension of the complete kit (both the shoulder straps 130 and side cummerbund or clips formed by cummerbund portions 140 of the plate carrier (100, 200)) are part of the outer plate carrier (100, 200), this configuration allows user or wearer scalability in the following manner: (i) plate carrier (100, 200) with hard ballistic plates (120, 220) only, (ii) plate carrier (100, 200) with hard plates (120, 220) and the front panel carrier 500 with soft ballistic panel 510 and/or the rear panel carrier 600 with soft ballistic panel 610, and (iii) plate carrier (100, 200) without hard plates and the front panel carrier 500 with soft ballistic panel 510 and the rear panel carrier 600 with soft ballistic panel 610.

As stated above, even without the hard plates (120, 220) inserted, the "outer" plate carrier (100, 200) can be worn with the soft panels inserted into the panel carrier (500, 600) in the combined configuration. This is due to the fact that the suspension (e.g., provided by the shoulder straps 130 and cummerbund portions 140) is attached to the "outer" plate carrier (100, 200), thus putting inward forces on the panel carrier (500, 600) towards the wearer's body, which assists in stabilizing and securing the panel carrier (500, 600) onto the wearer. If the user desires to only wear the hard plates (120, 220), the soft panel carrier (500, 600) is simply detached. This allows for the removal of not just the soft ballistic panels, but all the fabric that makes up the panel carrier (500, 600). This greatly reduces weight, bulk, and heat retention.

This dual armor variably enhanced body armor kit can be used with either concealable shaped ballistic panels or other shape variations. Furthermore, this kit can be utilized with non-ballistic cummerbunds as illustrated above or with cummerbunds containing ballistic material. These variations expand the possible scalability of this system.

The inventive concepts taught by way of the examples discussed above are amenable to modification, rearrangement, and embodiment in several ways. For example, this invention may be applicable for bulletproof clothing items other than vests including, for example, harnesses and coats. In addition, different methods of attaching the plate carrier with the panel carrier may be utilized other than the hook and loop fastener closure system. It is advantageous to utilizing a material on the front or rear plate carrier attachment portion of the inward facing side of the front or rear plate carrier (100, 200) that is mechanically nonabrasive (similar to loop material which is not capable of causing damage or irritation to the skin) to allow the plate carrier (100, 200) to be worn independently without causing damage to the clothing of the wearer or discomfort to the wearer's skin.

Accordingly, although the present disclosure has been described with reference to specific embodiments and examples, persons skilled in the art will recognize that changes may be made in form and detail without departing from the spirit and scope of the disclosure.

The claims define the invention and form part of the specification. Limitations from the written description are not to be read into the claims.

An interpretation under 35 U.S.C. § 112(f) is desired only where this description and/or the claims use specific terminology historically recognized to invoke the benefit of interpretation, such as "means," and the structure corresponding to a recited function, to include the equivalents thereof, as permitted to the fullest extent of the law and this written description, may include the disclosure, the accompanying claims, and the drawings, as they would be understood by one of skill in the art.

To the extent the subject matter has been described in language specific to structural features and/or methodological steps, it is to be understood that the subject matter defined in the appended claims is not necessarily limited to the specific features or steps described. Rather, the specific features and steps are disclosed as example forms of implementing the claimed subject matter. To the extent headings are used, they are provided for the convenience of the reader and are not be taken as limiting or restricting the systems, techniques, approaches, methods, devices to those appearing in any section. Rather, the teachings and disclosures herein can be combined, rearranged, with other portions of this disclosure and the knowledge of one of ordinary skill in the art. It is the intention of this disclosure to encompass and include such variation. The indication of any elements or steps as "optional" does not indicate that all other or any other elements or steps are mandatory.

What is claimed is:

1. A kit for assembling a scalable body armor for a wearer's body, the kit comprising:

a plurality of hard ballistic plates;

a plurality of soft ballistic panels;

a plate carrier including a front plate carrier and a rear plate carrier connected by shoulder straps, cummerbund portions extending laterally around the front plate carrier and the rear plate carrier and releasably connected to form a cummerbund around the wearer's body, the front plate carrier including a front plate carrier pocket to receive one of the hard ballistic plates, the rear plate carrier including a rear plate carrier pocket to receive another one of the hard ballistic plates, the front plate carrier having a front plate carrier attachment portion on an inward facing side which faces the wearer's body, the rear plate carrier having a rear plate carrier attachment portion on an inward facing side which faces the wearer's body;

a front panel carrier including a front panel carrier pocket to receive one of the soft ballistic panels and a front panel carrier attachment portion on an outward facing side which faces away from the wearer's body, the front panel carrier attachment portion and the front plate carrier attachment portion being configured to be releasably joinable together by contact with one another; and a rear panel carrier including a rear panel carrier pocket to receive another one of the soft ballistic panels and a rear panel carrier attachment portion on an outward facing side which faces away from the wearer's body, the rear panel carrier attachment portion and the rear plate carrier attachment portion being configured to be releasably joinable together by contact with one another.

2. The kit of claim 1, wherein the kit is configured to assemble a body armor according to any one of at least the following configurations: (i) the plate carrier having the hard ballistic plates in the front plate carrier pocket or the rear plate carrier pocket or both the front and rear plate carrier pockets; (ii) the plate carrier having the hard ballistic plates in the front plate carrier pocket or the rear plate carrier pocket or both the front and rear plate carrier pockets, the plate carrier releasably joined together with the front panel carrier which has one of the soft ballistic panels in the front panel carrier pocket or the rear panel carrier which has another one of the soft ballistic panels in the rear panel carrier pocket or both the front and rear panel carriers; and (iii) the plate carrier without any hard ballistic plates, the plate carrier releasably joined together with the front panel carrier which has one of the soft ballistic panels in the front panel carrier pocket or the rear panel carrier which has another one of the soft ballistic panels in the rear panel carrier pocket or both the front and rear panel carriers.

3. The kit of claim 1, wherein the front plate carrier attachment portion comprises a material which is mechanically nonabrasive; and wherein the rear plate carrier attachment portion comprises a material which is mechanically nonabrasive.

4. The kit of claim 3, wherein the front plate carrier attachment portion comprises a loop material;

wherein the rear plate carrier attachment portion comprises a loop material;

wherein the front panel carrier attachment portion comprises a hook material; and wherein the rear panel carrier attachment portion comprises a hook material.

5. The kit of claim 1, wherein the front plate carrier includes a front vertical strip of a stretch material on the inward facing side, the front vertical strip disposed between two parts of the front plate carrier attachment portion; and wherein the rear plate carrier includes a rear vertical strip of a stretch material on the inward facing side, the rear vertical strip disposed between two parts of the rear plate carrier attachment portion.

6. The kit of claim 5, wherein the front vertical strip and the front plate carrier attachment portion cover substantially an entire surface area of the inward facing side of the front plate carrier; and wherein the rear vertical strip and the rear plate carrier attachment portion cover substantially an entire surface area of the inward facing side of the rear plate carrier.

7. The kit of claim 1, further comprising:

a plurality of soft ballistic inserts;

wherein the cummerbund portions include built-in cummerbund pockets or separately attached or releasably connected cummerbund pockets to receive the soft ballistic inserts.

8. A scalable body armor system for a wearer's body, comprising:

a plate carrier including a front plate carrier and a rear plate carrier connected by shoulder straps, cummerbund portions extending laterally around the front plate carrier and the rear plate carrier, the front plate carrier including a front plate carrier pocket to receive a hard ballistic plate, the rear plate carrier including a rear plate carrier pocket to receive another hard ballistic plate, the front plate carrier having a front plate carrier attachment portion on an inward facing side which faces the wearer's body, the rear plate carrier having a rear plate carrier attachment portion on an inward facing side which faces the wearer's body;

a front panel carrier including a front panel carrier pocket to receive a soft ballistic panel and a front panel carrier attachment portion on an outward facing side which faces away from the wearer's body, the front panel carrier attachment portion and the front plate carrier attachment portion being configured to be releasably joinable together by contact with one another; and a rear panel carrier including a rear panel carrier pocket to receive another soft ballistic panel and a rear panel carrier attachment portion on an outward facing side which faces away from the wearer's body, the rear panel carrier attachment portion and the rear plate carrier attachment portion being configured to be releasably joinable together by contact with one another;

the cummerbund portions being configured to be releasably connected to form a cummerbund around the wearer's body which (i) presses the front panel carrier attachment portion and the front plate carrier attachment portion together and (ii) presses the rear panel carrier attachment portion and the rear plate carrier attachment portion together to form an integrated body armor around the wearer's body.

9. The scalable body armor system of claim 8, further comprising:

a plurality of hard ballistic plates, the front plate carrier pocket having one of the hard ballistic plates inserted therein and the rear plate carrier pocket having another one of the hard ballistic plates inserted therein.

10. The scalable body armor system of claim 9, further comprising:

a plurality of soft ballistic panels, the front panel carrier pocket having one of the soft ballistic panels inserted therein and the rear panel carrier pocket having another one of the soft ballistic panels inserted therein.

11. The scalable body armor system of claim 8, further comprising:

a plurality of soft ballistic panels, the front panel carrier pocket having one of the soft ballistic panels inserted therein and the rear panel carrier pocket having another one of the soft ballistic panels inserted therein.

12. The scalable body armor system of claim 8, wherein the front plate carrier attachment portion comprises a material which is mechanically nonabrasive; and wherein the rear plate carrier attachment portion comprises a material which is mechanically nonabrasive.

13. The scalable body armor system of claim 8, wherein the front plate carrier includes a front vertical strip of a stretch material on the inward facing side, the front vertical strip disposed between two parts of the front plate carrier attachment portion; and wherein the rear plate carrier includes a rear vertical strip of a stretch material on the inward facing side, the rear vertical strip disposed between two parts of the rear plate carrier attachment portion.

14. The scalable body armor system of claim 13, wherein the front vertical strip and the front plate carrier attachment portion cover substantially an entire surface area of the inward facing side of the front plate carrier; and wherein the rear vertical strip and the rear plate carrier attachment portion cover substantially an entire surface area of the inward facing side of the rear plate carrier.

15. The scalable body armor system of claim 8, wherein the cummerbund portions include built-in cummerbund pockets or separately attached or releasably connected cummerbund pockets to receive soft ballistic inserts.

16. A kit-of-parts for assembling a scalable body armor for a wearer's body, the kit-of-parts comprising:

a plurality of hard ballistic plates;

a plurality of soft ballistic panels;

a plate carrier including a front plate carrier and a rear plate carrier connected by shoulder straps, the front plate carrier including a front plate carrier pocket to receive one of the hard ballistic plates, the rear plate carrier including a rear plate carrier pocket to receive another one of the hard ballistic plates, the front plate carrier having a front plate carrier attachment portion on an inward facing side which faces the wearer's body, the rear plate carrier having a rear plate carrier attachment portion on an inward facing side which faces the wearer's body;

a front panel carrier including a front panel carrier pocket to receive one of the soft ballistic panels and a front panel carrier attachment portion on an outward facing side which faces away from the wearer's body, the front panel carrier attachment portion and the front plate carrier attachment portion being configured to be releasably joinable together by contact with one another;

a rear panel carrier including a rear panel carrier pocket to receive another one of the soft ballistic panels and a rear panel carrier attachment portion on an outward facing side which faces away from the wearer's body, the rear panel carrier attachment portion and the rear plate carrier attachment portion being configured to be releasably joinable together by contact with one another; and cummerbund portions configured to be releasably connected to form a cummerbund around the wearer's body, with the cummerbund portions extending from the rear plate carrier and attached to the front plate carrier, the cummerbund (i) pressing the front panel carrier attachment portion and the front plate carrier attachment portion together and (ii) pressing the rear panel carrier attachment portion and the rear plate carrier attachment portion together to form an integrated body armor around the wearer's body.

17. The kit-of-parts of claim 16, wherein the kit-of-parts is configured to assemble the integrated body armor according to any one of at least the following configurations: (i) the plate carrier having the hard ballistic plates in the front plate carrier pocket or the rear plate carrier pocket or both the front and rear plate carrier pockets; (ii) the plate carrier having the hard ballistic plates in the front plate carrier pocket or the rear plate carrier pocket or both the front and rear carrier pockets, the plate carrier releasably joined together with the front panel carrier which has a soft ballistic panel in the front panel carrier pocket or the rear panel carrier which has a soft ballistic panel in the rear panel carrier pocket or both the front and rear panel carriers; and (iii) the plate carrier without any hard ballistic plates, the plate carrier releasably joined together with the front panel carrier which has a soft ballistic panel in the front panel carrier pocket or the rear panel carrier which has a soft ballistic panels in the rear panel carrier pocket or both the front and rear panel carriers.

18. The kit-of-parts of claim 16, wherein the front plate carrier attachment portion comprises a material which is mechanically nonabrasive; and wherein the rear plate carrier attachment portion comprises a material which is mechanically nonabrasive.

19. The kit-of-parts of claim 16, wherein the front plate carrier includes a front vertical strip of a stretch material on the inward facing side, the front vertical strip disposed between two parts of the front plate carrier attachment portion; and wherein the rear plate carrier includes a rear vertical strip of a stretch material on the inward facing side, the rear vertical strip disposed between two parts of the rear plate carrier attachment portion.

20. The kit-of-parts of claim 19, wherein the front vertical strip and the front plate carrier attachment portion cover substantially an entire surface area of the inward facing side of the front plate carrier; and wherein the rear vertical strip and the rear plate carrier attachment portion cover substantially an entire surface area of the inward facing side of the rear plate carrier.

* * * * *